US007043177B2

(12) United States Patent
Kim et al.

(10) Patent No.: US 7,043,177 B2
(45) Date of Patent: May 9, 2006

(54) TONER/DEVELOPER MIXING ROLLER AND DEVELOPING DEVICE FOR LASER PRINTER

(75) Inventors: Ho-dong Kim, Youngin (KR); Min-soo Lee, Uiwang (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 26 days.

(21) Appl. No.: 10/404,078

(22) Filed: Apr. 2, 2003

(65) Prior Publication Data

US 2005/0100366 A1 May 12, 2005

(30) Foreign Application Priority Data

Aug. 14, 2002 (KR) ..... 2002-48281

(51) Int. Cl.
*G03G 15/08* (2006.01)
*B01F 13/00* (2006.01)

(52) U.S. Cl. ..... 399/256; 366/343; 399/254

(58) Field of Classification Search ..... 399/252, 399/254, 255, 256, 258, 263; 366/244, 279, 366/342, 343

See application file for complete search history.

(56) References Cited

U.S. PATENT DOCUMENTS

| | | | | |
|---|---|---|---|---|
| 4,312,596 | A * | 1/1982 | Maezawa et al. | 366/343 |
| 4,948,262 | A * | 8/1990 | Tome, Jr. | 366/343 X |
| 5,887,224 | A * | 3/1999 | Mizuishi et al. | 399/256 X |
| 6,456,810 | B1 * | 9/2002 | Deguchi et al. | 399/254 |

FOREIGN PATENT DOCUMENTS

| | | | |
|---|---|---|---|
| JP | 08-123168 | * | 5/1996 |
| JP | 10-063081 | * | 3/1998 |
| JP | 2001-175082 | * | 6/2001 |

* cited by examiner

*Primary Examiner*—Sandra L. Brase
(74) *Attorney, Agent, or Firm*—Staas & Halsey LLP

(57) ABSTRACT

A toner/developer mixing roller is rotatably disposed in an inside of a housing to mix a developer with toner supplied into the housing to supply a mixture of the developer and the toner to a developing roller. The toner/developer mixing roller includes a roller body and a sheet of a reticular form rolled around the roller body.

27 Claims, 3 Drawing Sheets

TONER/DEVELOPER MIXING ROLLER AND DEVELOPING DEVICE FOR LASER PRINTER

CROSS-REFERENCE TO RELATED APPLICATIONS

This application claims the benefit of Korean Patent Application No. 2002-48281, filed Aug. 14, 2002, in the Korean Intellectual Property Office, the disclosure of which is incorporated herein by reference.

BACKGROUND OF THE INVENTION

1. Field of the Invention

The present invention relates to a toner/developer mixing roller and developing device for a laser printer, and more particularly, to a toner/developer mixing roller disposed in a developing device to mix toner and a developer in a laser printer.

2. Description of the Related Art

Generally, a laser printer comprises a printer body, a developing device disposed in an inside of the printer body with a photoconductive drum, a laser scanning unit projecting a laser beam to the photoconductive drum to form an electrostatic latent image thereon, and a toner supply unit supplying toner to develop the electrostatic latent image formed on the photoconductive drum.

The developing device comprises a housing supporting the photoconductive drum to rotate while being in contact with a preselected transfer roller, a charging unit disposed in the inside of the housing to charge the photoconductive drum, a developing roller transferring the toner supplied to the inside of the housing to the photoconductive drum, and a cleaning blade removing used toner remaining on the developing roller and photoconductive drum.

The toner supply unit is removably disposed at a printer body of the laser printer. The toner supply unit has a toner cartridge having a toner discharger and new toner stored inside thereof. The toner cartridge is disposed at the printer body as being connected to the housing through a preselected toner supply passage. The toner cartridge is generally disposable, and thus, after being used up, it is replaced by a new one.

For a developing operation of the above construction, the toner stored in the toner cartridge is supplied to the inside the housing of the developing device through the toner supply passage.

A developing device for a binary developer comprises a toner/developer mixing roller mixing supplied toner with a developer or a carrier, which is prepared inside the housing. The mixing roller disposed inside the housing rotates to mix the developer prepared inside the housing with the toner supplied to the inside the housing and then transferred by a preselected toner supply roller.

FIG. 1 is a perspective view schematically showing a toner/developer mixing roller 10 of a conventional laser printer. Referring to FIG. 1, the mixing roller 10 includes a hollow body 11, on which ribs 13 are formed along a longitudinal direction of hollow body 11 at predetermined intervals, that is, slits 15 alternating with the ribs 13 are formed. The ribs 13 slant to one direction with respect to the longitudinal direction, that is, in a spiral form. The mixing roller of this shape rotates to mix the toner and the developer, thereby supplying the mixture to a developing roller.

A concentration distribution of the toner and the developer in the mixture is not uniform due to the intervals of the ribs 13.

The spiral slant of the ribs causes the mixture of the developer and the toner contained in the inside of the housing to cluster together on a side of the housing or the mixing roller 10. This causes a problem that an intensity of a developed image is uneven across a sheet of paper besides the cluster problem occurring due to the intervals of the ribs 13.

SUMMARY OF THE INVENTION

An aspect of the invention is to solve at least the above problems and/or disadvantages and to provide a toner/developer mixing roller and a developing device of a laser printer having an improved feature capable of mixing toner and a developer uniformly.

Additional aspects and advantages of the invention will be set forth in part in the description which follows and, in part, will be obvious from the description, or may be learned by practice of the invention.

According to an aspect of the present invention, a toner/developer mixing roller rotatably disposed in an inside of a housing to mix a developer with toner supplied into the housing to supply a mixture of the developer and the toner to a developing roller. The toner/developer mixing roller comprises a roller body and a sheet of a reticular form rolled around the roller body. The reticular form may be formed with lines and spaces, concave portions, or convex portions formed by lines.

According to another aspect of the present invention, the roller body of the toner/developer mixing roller includes a sheet disposing part depressed inwardly between sides of the roller body to have a smaller diameter than those of the sides of the roller body, thereby receiving the sheet.

According to another aspect of the present invention, a developing device comprises a housing receiving a photoconductive drum, a developing roller disposed in an inside of the housing to supply toner mixed with a developer to the photoconductive drum, a supply roller supplying the toner mixed with the developer to the developing roller, a toner/developer mixing roller rotatably disposed between the developing roller and the supply roller to mix the developer with the toner supplied into the housing, and a sheet of a reticular form rolled around the toner/developer mixing roller.

According to another aspect of the present invention, the toner/developer mixing roller of the developing device includes a sheet disposing part depressed inwardly to receive the sheet between sides thereof.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
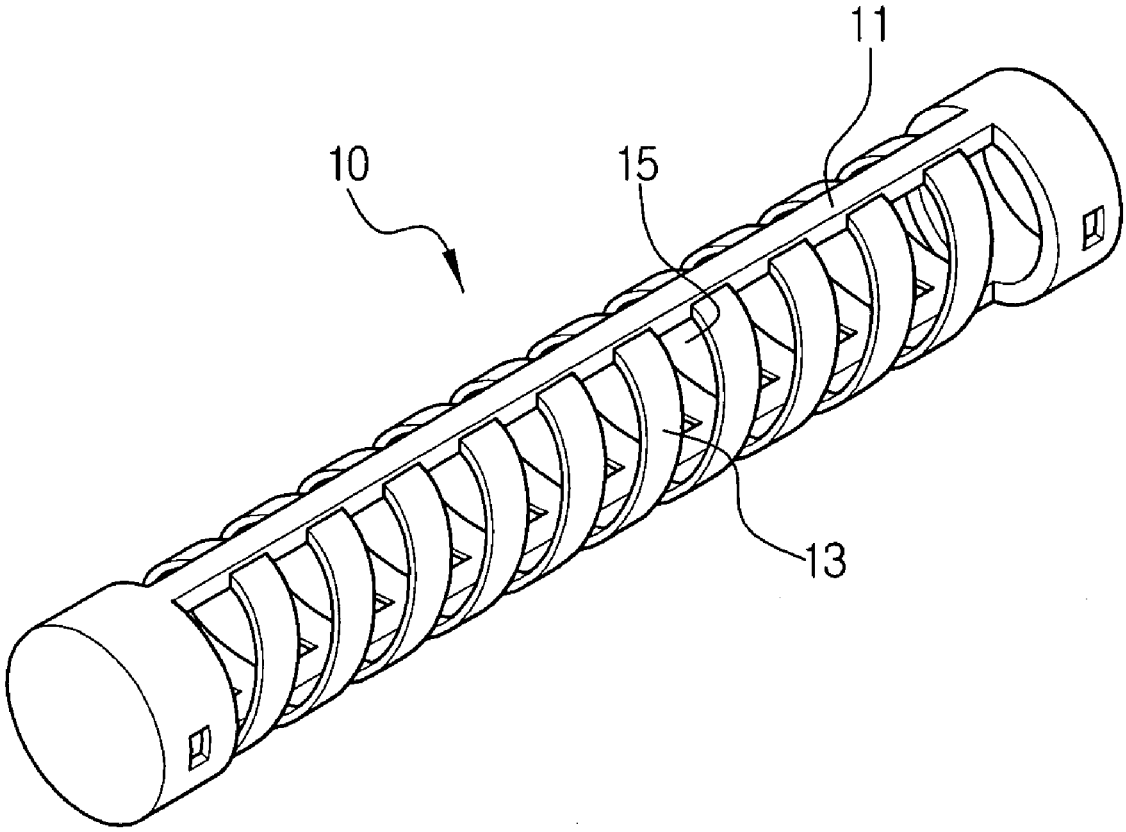
FIG. 1 (PRIOR ART)
FIG. 1 is a perspective view showing a toner/developer mixing roller of a conventional laser printer.

Reference will now be made in detail to the preferred embodiment of the present invention, examples of which are illustrated in the accompanying drawings, wherein like reference numerals refer to the like elements throughout. The embodiment is described in order to explain the present invention by referring to the figures.

Figure 2:
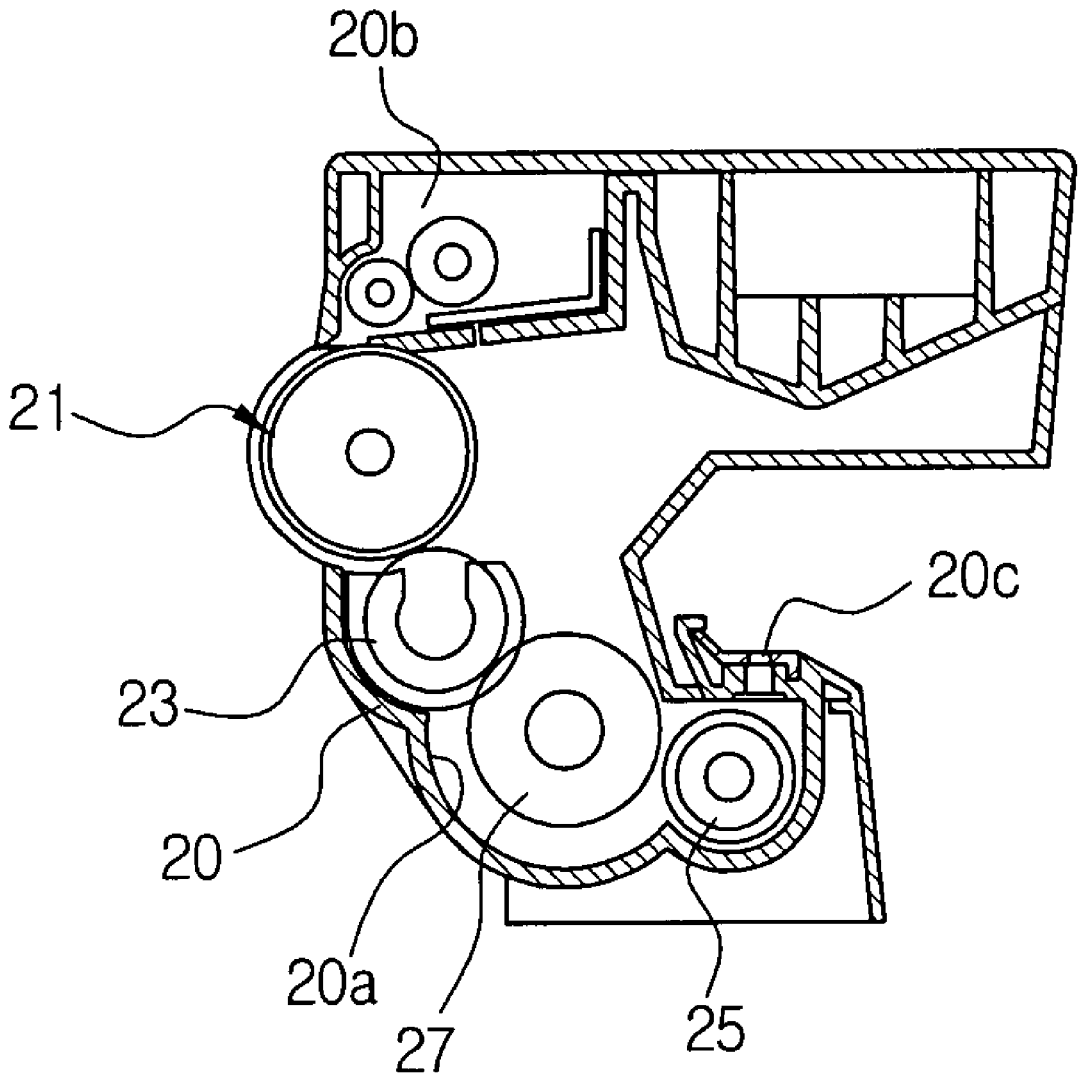
FIG. 2 is a schematic view showing a construction of a developing device in a laser printer in accordance with an embodiment of the invention.

FIG. 2 is a schematic view showing a construction of a developing device in a laser printer in accordance with an embodiment of the invention. Referring to FIG. 2, the developing device comprises a housing 20 having a photoconductive drum 21, a developing roller 23 disposed in an inside of the housing 20 to supply toner mixed with a developer to the photoconductive drum 21, a supply roller 25 supplying the toner mixed with the developer to the developing roller 23, and a toner/developer mixing roller 27 disposed between the developing roller 23 and the supply roller 25.

The photoconductive drum 21 develops a toner image by a general electrophotographic developing process to transfer the developed image to a paper. In detail, the photoconductive drum 21 is charged with a predetermined electric potential by a charging device (not shown). An electrostatic latent image is formed on the charged surface partly exposed by a laser beam projected by a laser scanning unit. The toner supplied by the developing roller 23 is transferred to an electrostatic latent image region to form the toner image. The toner image is transferred to the paper passing through the photoconductive drum 21 and a transfer roller (not shown).

The housing 20 includes a first chamber 20*a* storing the developer mixed with the toner and a second chamber 20*b* removing used toner cleaned out of the photoconductive drum 21. The first chamber 20*a* includes the developing roller 23, the supply roller 25 and the mixing roller 27. The first chamber 20*a* further includes a toner supply port 20*c* providing a passage to the toner supplied from a toner cartridge (not shown) to the inside of the housing 20.

The supply roller 25 is rotatably disposed to correspond to the toner supply port 20*c*. The supply roller 25 rotates to supply the mixing roller 27 with the toner fed to the first chamber 20*a*. A predetermined developer, i.e., a carrier, to be mixed with the supplied toner is stored in an inside of the first chamber 20*a* of the housing 20. As is well known to those skilled in the art, the carrier is used in the developing process using a binary developer, and a detailed description will be omitted here.

The developing roller 23 is rotatably disposed to have a developing gap with the photoconductive drum 21. The developing roller 23 supplies a predetermined amount of the developer mixed with the toner by the mixing roller 27 to the photoconductive drum 21.

Figure 3:
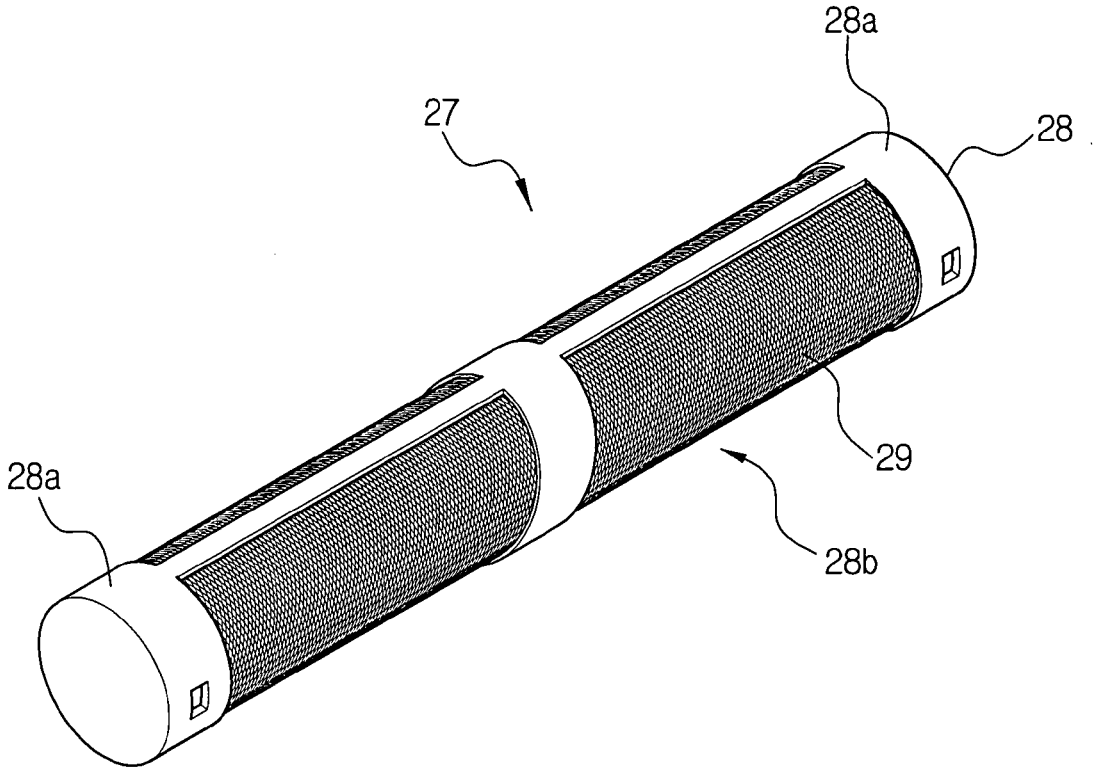
FIG. 3 is a perspective view showing a toner/developer mixing roller of the developing device shown in FIG. 2.

The mixing roller 27 is rotatably disposed between the developing roller 23 and the supply roller 25. As shown in FIG. 3, the mixing roller 27 includes a roller body 28 and a sheet 29 of a reticular form rolled around a cylinder of the roller body 28. The reticular form may be formed with lines and spaces, concave portions, or convex portions formed by lines.

The roller body 28 has a sheet disposing part 28*b* depressed inwardly between sides 28*a* of the body to have a smaller diameter than that of each of the sides 28*a* of the roller body 28. The sheet 29 tightly contacts a surface of the sheet disposing part 28*b*. The mixing roller 27 with this construction rotates to mix the toner with the developer through the sheet 29.

Furthermore, the mixing roller 27 does not have spiral ribs shown in a conventional mixing roller, thus problems of a nonuniform concentration distribution of the toner and the developer due to a form of ribs of the conventional mixing roller causing the toner and developer to be clustered to a side of the conventional mixing roller can be resolved.

By using the developing device having the above mixing roller 27 to develop the toner image, an intensity of the toner image printed on the paper is even and uniform along a widthwise direction of the paper.

While the invention has been shown and described with reference to certain preferred embodiment thereof, it will be understood by those skilled in the art that various changes in form and details may be made therein without departing from the spirit and scope of the invention as defined by the appended claims.

The foregoing embodiment and advantages are merely exemplary and are not to be construed as limiting the present invention. The present teaching can be readily applied to other types of apparatuses. The description of the present invention is intended to be illustrative, and not to limit the scope of the claims. Many alternatives, modifications, and variations will be apparent to those skilled in the art.

What is claimed is:

1. A toner/developer mixing roller rotatably disposed in an inside of a housing to mix a developer with toner supplied into the housing to supply a mixture of the developer and the toner to a developing roller, the toner/developer mixing roller comprising:

a roller body; and a sheet, rolled circumferentially around the roller body, to form a cylinder to partially cover an area of the roller body.

2. A toner/developer mixing roller rotatably disposed in an inside of a housing to mix a developer with toner supplied into the housing to supply a mixture of the developer and the toner to a developing roller, the toner/developer mixing roller comprising:

a roller body; and a sheet, tightly rolled around the roller body, to partially cover an area of the roller body, wherein the roller body comprises:

sides formed on opposite sides of the roller body; and a sheet disposing part depressed inwardly between the sides of the roller body to have a smaller diameter than those of the sides of the roller body, thereby receiving the sheet.

3. A developing device comprising:

a housing receiving a photoconductive drum;

a developing roller disposed inside of the housing, to supply toner mixed with a developer to the photoconductive drum;

a supply roller supplying the toner mixed with the developer to the developing roller;

a toner/developer mixing roller rotatably disposed between the developing roller and the supply roller to mix the developer with the toner supplied into the housing; and a sheet, rolled circumferentially around the toner/developer mixing roller, to form a cylinder to partially cover an area of the toner/developer mixing roller.

4. A developing device comprising:

a housing receiving a photoconductive drum;

a developing roller disposed inside of the housing, to supply toner mixed with a developer to the photoconductive drum;

a supply roller supplying the toner mixed with the developer to the developing roller;

a toner/developer mixing roller rotatably disposed between the developing roller and the supply roller to mix the developer with the toner supplied into the housing; and a sheet, tightly rolled around the toner/developer mixing roller, to partially cover an area of the toner/developer mixing roller, wherein the toner/developer mixing roller comprises:

a sheet disposing part depressed inwardly to receive the sheet between sides thereof.

5. A developing device comprising:

a toner/developer mixing roller having a roller body and a sheet disposing part formed on the roller body; and a sheet, rolled circumferentially around the toner/developer mixing roller, to form a cylinder to partially cover an area of the sheet disposing part.

6. The developing device of claim 5, further comprising:

a housing containing a developer and toner, wherein the toner/developer mixing roller is rotatably disposed inside of the housing.

7. The developing device of claim 6, further comprising:

a photoconductive drum;

a developing roller supplying the toner mixed with a developer to the photoconductive drum; and a supply roller supplying the toner mixed with the developer to the developing roller, wherein the toner/developer mixing roller is disposed between the developing roller and the supply roller.

8. The developing device of claim 7, wherein the photoconductive drum, the developing roller, and the supply roller are rotatably disposed inside of the housing.

9. The developing device of claim 8, wherein the housing comprises an opening, and the photoconductive drum is exposed to an outside of the housing through the opening.

10. The developing device of claim 5, wherein the roller body comprises:

sides disposed on opposite sides of the roller body in an axial direction of the roller body.

11. The developing device of clam 10, wherein the sheet disposing part of the roller body is formed between the sides.

12. A developing device comprising:

a toner/developer mixing roller having a roller body and a sheet disposing part formed on the roller body; and a sheet, tightly rolled around the toner/developer mixing roller, to partially cover an area of the sheet disposing part, wherein the roller body comprises:

sides disposed on opposite sides of the roller body in an axial direction of the roller body, wherein the sides have a first diameter, and the sheet disposing part of the roller body has a second diameter smaller than the first diameter.

13. A developing device comprising:

a toner/developer mixing roller having a roller body and a sheet disposing part formed on the roller body, wherein the roller body comprises sides disposed on opposite sides of the roller body in an axial direction of the roller body; and a sheet, rolled circumferentially around the toner/developer mixing roller, to partially cover an area of the sheet disposing part, wherein the sheet disposing part of the roller body is depressed inwardly between the sides of the roller body to receive the sheet.

14. A developing device comprising:

a toner/developer mixing roller having a roller body and a sheet disposing part formed on the roller body, wherein the roller body comprises sides disposed on opposite sides of the roller body in an axial direction of the roller body; and a sheet, rolled circumferentially around the toner/developer mixing roller, to partially cover an area of the sheet disposing part, wherein the sheet disposing part of the roller body has a depth with respect to one of the sides to receive the sheet.

15. The developing device of clam 14, wherein the sheet has a thickness equal to or less than the depth.

16. The developing device of clam 5, wherein the sheet is attached on a surface of the sheet disposing part of the roller body.

17. The developing device of clam 5, wherein the sheet comprises;

a plurality of lines; and one or a combination of a space, a concave portion, and a convex portion each formed between the lines.

18. The developing device of clam 5, wherein the sheet is disposed in a longitudinal direction of the roller body.

19. The developing device of clam 5, wherein the sheet is wound around the roller body in a circular direction of the roller body.

20. A developing device comprising:

a toner/developer mixing roller having a roller body and a sheet disposing part formed on the roller body; and a sheet, tightly rolled around the toner/developer mixing roller, to partially cover an area of the sheet disposing part, wherein the toner/developer mixing roller comprises another sheet disposing part formed on the roller body.

21. The developing device of clam 20, wherein the sheet disposing part and the another sheet disposing part are arranged in a longitudinal direction of the roller body.

22. The developing device of clam 20, further comprising: another sheet having the reticular form and disposed in the another sheet disposing part.

23. The developing device of clam 22, wherein the another sheet is wound around the roller body in a circular direction.

24. The developing device of clam 22, wherein the another sheet is fixedly attached on a surface of the another sheet disposing part.

25. A roller in an image forming device to mix a developer and toner so as to supply a mixture of the developer and the toner to a developing roller, the roller comprising:

a substantially cylindrical body to rotate about a longitudinal axis thereof and to define a space therein in which the mixture is mixed during an operation of the body; and a sheet, tightly rolled around the substantially cylindrical body to form a cylinder to partially cover an area of the substantially cylindrical body, the sheet having a raised reticular pattern formed thereon, wherein the raised reticular pattern distributes the mixture substantially constantly during the operation of the body.

26. A developing device, including a housing to receive a photoconductive drum, a developing roller to supply a mixture of toner and developer to the photoconductive drum, and a supply roller to supply the mixture to the developing roller, the developing device comprising:

a substantially cylindrical body to rotate about a longitudinal axis thereof and to define a space therein in which the mixture is mixed during an operation of the body; and a sheet, rolled circumferentially around the substantially cylindrical body to form a cylinder to partially cover an area of the substantially cylindrical body, the sheet having a raised reticular pattern formed thereon, wherein the raised reticular pattern distributes the mixture substantially constantly during the operation of the body.

27. A roller in an inside of an image forming device to mix a developer and toner to supply a mixture of the developer and the toner to a developing roller, the roller comprising:

a substantially cylindrical body, including a sheet disposing part, to rotate about a longitudinal axis thereof and to define a space therein in which the developer and toner are mixed during an operation of the body; and a sheet, rolled circumferentially around the substantially cylindrical body to form a cylinder to partially cover an area of the substantially cylindrical body, the sheet having a raised reticular pattern formed thereon, wherein the raised reticular pattern distributes the mixture substantially constantly during the operation of the body.

* * * * *

UNITED STATES PATENT AND TRADEMARK OFFICE

CERTIFICATE OF CORRECTION

PATENT NO. : 7,043,177 B2
APPLICATION NO. : 10/404078
DATED : May 5, 2006
INVENTOR(S) : Ho-dong Kim et al.

It is certified that error appears in the above-identified patent and that said Letters Patent is hereby corrected as shown below:

Column 5, Line 46, change “clam” to --claim--.

Column 6, Line 16, change “clam” to --claim--.

Column 6, Line 18, change “clam” to --claim--.

Column 6, Line 21, change “clam” to --claim--.

Column 6, Line 26, change “clam” to --claim--.

Column 6, Line 28, change “clam” to --claim--.

Column 6, Line 39, change “clam” to --claim--.

Column 6, Line 42, change “clam” to --claim--.

Column 6, Line 45, change “clam” to --claim--.

Column 6, Line 48, change “clam” to --claim--.

Signed and Sealed this

Twenty-eighth Day of November, 2006

JON W. DUDAS
*Director of the United States Patent and Trademark Office*

UNITED STATES PATENT AND TRADEMARK OFFICE

CERTIFICATE OF CORRECTION

PATENT NO. : 7,043,177 B2
APPLICATION NO. : 10/404078
DATED : May 9, 2006
INVENTOR(S) : Ho-dong Kim et al.

It is certified that error appears in the above-identified patent and that said Letters Patent is hereby corrected as shown below:

Column 5, Line 46, change “clam” to --claim--.

Column 6, Line 16, change “clam” to --claim--.

Column 6, Line 18, change “clam” to --claim--.

Column 6, Line 21, change “clam” to --claim--.

Column 6, Line 26, change “clam” to --claim--.

Column 6, Line 28, change “clam” to --claim--.

Column 6, Line 39, change “clam” to --claim--.

Column 6, Line 42, change “clam” to --claim--.

Column 6, Line 45, change “clam” to --claim--.

Column 6, Line 48, change “clam” to --claim--.

This certificate supersedes Certificate of Correction issued November 28, 2006.

Signed and Sealed this

Second Day of January, 2007

JON W. DUDAS
*Director of the United States Patent and Trademark Office*